United States Patent [19]

Miyoshi et al.

[11] Patent Number: 4,839,263

[45] Date of Patent: Jun. 13, 1989

[54] METHOD OF FORMING DYE IMAGE HAVING SUPERIOR RAPID PROCESSING PERFORMANCE

[75] Inventors: Masanobu Miyoshi; Makoto Kajiwara; Kaoru Onodera, all of Odawara; Eiichi Sakamoto, Hino, all of Japan

[73] Assignee: Konishiroku Photo Industry Co., Ltd., Tokyo, Japan

[21] Appl. No.: 79,220

[22] Filed: Jul. 29, 1987

[30] Foreign Application Priority Data

Jul. 31, 1986 [JP] Japan ..... 61-180974

[51] Int. Cl.[4] ..... G03C 5/26; G03C 1/30; G03C 1/34

[52] U.S. Cl. ..... 430/384; 430/385; 430/386; 430/387; 430/489; 430/490; 430/467; 430/611; 430/605; 430/626; 430/551; 430/963

[58] Field of Search ..... 430/489, 490, 467, 611, 430/614, 626, 551, 963, 385, 384, 386, 387, 388, 389

[56] References Cited

U.S. PATENT DOCUMENTS

| | | | |
|---|---|---|---|
| 3,305,362 | 2/1967 | Riester et al. | 430/611 |
| 3,335,009 | 8/1967 | Rasch et al. | 430/611 |
| 4,170,478 | 10/1979 | Case et al. | 430/467 |
| 4,252,892 | 2/1981 | Case | 430/489 |
| 4,565,774 | 1/1986 | Kajiwara et al. | 430/489 |
| 4,565,776 | 1/1986 | Kim et al. | 430/490 |
| 4,661,441 | 4/1987 | Kajiwara et al. | 430/626 |
| 4,734,358 | 3/1988 | Takada et al. | 430/626 |

FOREIGN PATENT DOCUMENTS

| | | |
|---|---|---|
| 0080905 | 6/1983 | European Pat. Off. . |
| 0122125 | 10/1984 | European Pat. Off. . |
| 2302676 | 7/1973 | Fed. Rep. of Germany . |

*Primary Examiner*—Paul R. Michl
*Assistant Examiner*—Mark R. Buscher
*Attorney, Agent, or Firm*—Jordan B. Bierman

[57] ABSTRACT

A silver halide photographic material containing a support and, provided thereon, at least one silver halide emulsion layer, this silver halide emulsion layer containing silver halide grains containing 90 mol % or more of silver chloride, a dye-forming coupler, and a compound represented by general formula [S];

[S]

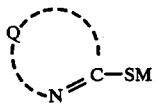

wherein Q is a group of atoms necessary to complete a 5- or 6-membered heterocyclic ring or a 5- or 6-membered ring fused with a benzene ring and M is a hydrogen atom, an alkali metal or an ammonium group;

the silver halide layer having been hardened by a hardener represented by formula [HDA] or [HDB];

[HDA]

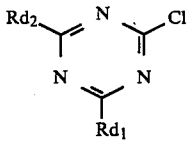

wherein $Rd_1$ is selected from the group consisting of a chlorine atom, a hydroxyl group, an alkyl group, an alkoxy group, an alkylthio group, an —OM group, wherein M is an mono-valent metal atom, a —NR′R″ group, wherein R′ and R″ are independently selected from the group consisting of a hydrogen atom, an alkyl group and an aryl group and a —NHCOR‴ group, in which R‴ is selected from the group consisting of a hydrogen atom, an alkyl group and an aryl group; $Rd_2$ is selected from the group consisting of a hydroxyl group, an alkyl group, an alkoxy group, an alkylthio group, an —OM group, wherein M is an mono-valent metal atom, a —NR′R″ group, wherein R′ and R″ are independently selected from the group consisting of a hydrogen atom, an alkyl group and an aryl group and a —NHCOR‴ group, in which R‴ is selected from the group consisting of a hydrogen atom, an alkyl group and an aryl group;

[HDB]

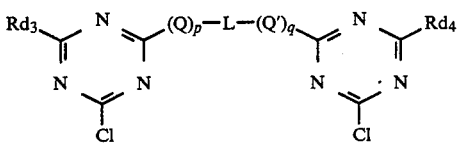

wherein $Rd_3$ and $Rd_4$ are independently selected from the group consisting of a chlorine atom, a hydroxyl group, an alkyl group, an alkoxy group and an —OM group, in which is a mono-valent metal atom; Q and Q′ is a divalent atom or group selected from —O—, —S— and —NH—; L is an alkylene group or an arylene group; and p and q are independently integers of 0 or 1. The above-described silver halide photographic material is processed with a color developing solution containing a sulfite ion in a quantity of $2\times10^{-4}$ to $1\times10^{-2}$ moles per liter, this developing solution being substantially free of bromide ion. The above-described material and process for developing the same, being better suited for use in rapid developing processes.

11 Claims, No Drawings

METHOD OF FORMING DYE IMAGE HAVING SUPERIOR RAPID PROCESSING PERFORMANCE

FIELD OF THE INVENTION

The present invention relates to a method of forming a dye image, and more particularly, to a method of forming a dye image whose sensitometry variation due to the difference in the stirring condition for a color developing solution is small enough to enable rapid processing, and such that the minimum density of a dye image to be formed is sufficiently small.

BACKGROUND OF THE INVENTION

Recent years, in the present photographic field, what have been sought after are light-sensitive silver halide photographic materials that can practice rapid processing, may have high image quality and yet superior processing stability, and can be of low cost. Particularly sought after are light-sensitive silver halide photographic materials that can be processed rapidly.

Namely, it is practiced to continuously process light-sensitive silver halide photographic materials usually in an automatic processing machine installed in every photofinishing laboratory. However, as a part of improvement in services to users, it is desired to finish processing and return products to users in the day the development orders were received, and, nowadays, it is further desired even to return products in several hours after receipt of orders, whereby there is increasing necessity for the rapid processing. Development of the rapid processing is also hastened because a shortened processing time may bring about increase in the production efficiency and a cost decrease may be thereby made possible.

To achieve the rapid processing, there have been made approaches from tow aspects, i.e., a light-sensitive material and a processing solution. In respect of the color developing processing, it has been attempted to make higher the temperature, pH and concentration of a color developing agent, and it is also known to add additives such as development accelerators. The above development accelerators may include 1-phenyl-3-pyrazolidone disclosed in British Pat. No. 811,185, N-methyl-p-aminophenol disclosed in U.S. Pat. No. 2,417,514, N,N,N', N'-tetrametyl-p-phenylenediamine disclosed in Japanese Patent Publication Open to Public Inspection (hereinafter referred to as Japanese Patent O.P.I. Publication) No. 15554/1975, etc. The method using these, however, can achieve no sufficient rapidness, and may be often accompanied with deterioration of performance such as increase in fog.

On the other hand, the shape, size and composition of silver halide grains of a silver halide emulsion used in the light-sensitive material are known to greatly affect the development speed and so forth. In particular, it is found that the halogen composition may greatly affect the same and a very remarkably high development speed can be shown when a chloride-rich silver halide is used.

However, usually the fog may also greatly increase when it is intended to maintain a high development performance of the chloride-rich silver halide emulsion.

Particularly in a color developing system rather than a black and white developing system, in which a color developing dye is formed, the fog density may become more remarkable as compared with the black and white system, to give an important problem in an attempt to sufficiently exhibit the feature of the rapid processing performance of the chloride-rich silver halide emulsion.

To decrease the fog density, generally used are antifoggants. One of best known antifoggants is potassium bromide, which has been conventionally used in various developing solutions. However, the rapid processing performance may be seriously injured when a material employing the chloride-rich silver halide emulsion is processed in the system of a color developing solution containing potassium bromide. This means that the potassium bromide may act as a very strong development restrainer against the chloride-rich silver halide emulsion before it may prevent the fog. Accordingly, when the rapid processing performance is aimed at, it becomes necessary for the color developing solution used in the system of the chloride-rich silver halide emulsion not to substantially contain any potassium bromide, whereby the condition may become further disadvantageous in respect of the fog.

On the other hand, there have been also known a great number of organic restrainers as other antifoggants, as disclosed, for example, in E. J. Birr, "Stabilization of Photographic Silver Halide Emulsions", Focal Press (1974). Of these antifoggants, heterocyclic mercapto compounds may generally have strong antifoggant effect, and have been well known for a long time. However, the heterocyclic mercapto compounds can be effective for prevention of the fog and at the same time can have considerably strong development restraining effect, and therefore there is a limit in the amount for their use. The heterocyclic mercapto compounds can also show effective antifoggant effect against the chloride-rich silver halide emulsion, but, when they are added in such an amount that the fog can be sufficiently suppressed, the rapid processing performance may be inhibited, though not so strong as in the case of potassium bromide, to greatly diminish the feature coming from the employment of the chloride-rich silver halide emulsion. The fog practically problematic may also be generated at the amount that may satisfy the rapid processing performance. Thus, it has been strongly desired to develop a technique to solve the dilemma such that the rapid processing performance must be maintained and simultaneously the fog must be suppressed in the chloride-rich silver halide emulsion having fundamentally a high developing performance.

Meanwhile, with progress in rapidness of the processing, a property that may have not been questioned so much in the past may come out as a new problem. What is thus questioned is the sensitometry variation of a dye image, that may result from the difference in how vigorously or mildly a developing solution in the color developing is stirred or how frequently it is stirred. When remarkable rapidness is achieved in the processing, the color developing speed may also greatly increase as a matter of course, and, in such a state, the above factor may necessarily have an important influence.

Conventionally, although the degree of how readily the influence by the stirring in the color developing processing may be had (hereinafter referred to as "stirring strength dependence") has not been so much discussed, this is one of the factors of sensitometry performance variation in the actual market. More specifically, in the market, the processing of light-sensitive silver halide photographic material is carried out in an automatic processing machine (hereinafter referred to as "autoprocessor"). The autoprocessor may be variously of a roll automatic processing type, a sheet automatic processing type or a hanger automatic processing type. Further, even in the same roll automatic processing type one, the conveyance speed may vary in the wide range of about 1 m to 20 m/min, and, in respect also of the roll automatic processing type one, the manner of conveyance may vary depending on the manufacturers and the type of machines. Depending on these type, conveyance speed and conveyance manner, there may be great difference in the stirring efficiency, and, in those having great stirring strength dependence, the sensitometry variation may become great in the market, raising an important problem in the quality stability.

SUMMARY OF THE INVENTION

Accordingly, an object of the present invention is to provide a method of forming a dye image that can achieve a superior rapid processing performance, can suppress the minimum density of a dye image to be formed to a sufficiently low degree, and also can be small in the sensitometry variation due to the difference in the stirring conditions for a color developing solution.

The above object of the present invention can be achieve by a method of forming a dye image, comprising subjecting to an image exposure a light-sensitive silver halide photographic material having a support and provided thereon with at least one silver halide emulsion layer containing a dye-forming coupler, followed by photographic processing including color developing processing, wherein the method is characterized in that at least one of said silver halide emulsion layer contains (i) silver halide grains containing 90 mole % or more of silver chloride as a light-sensitive silver halide and (ii) a compound represented by General Formula (S) shown below, and that a color developing solution used in said color developing processing contains $2\times10^{-4}$ to $1\times10^{-2}$ mole/lit of sulfite ions and is substantially free from bromide ion. General Formula (S):

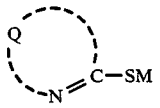

wherein Q is a group of atoms necessary to complete a 5- or 6-membered heterocyclic ring or a 5- or 6-membered ring fused with a benzene ring and M is a hydrogen atom, an alkali metal or an ammonium group;

DETAILED DESCRIPTION OF THE INVENTION

[Specific constitution of the invention]

The light-sensitive silver halide photographic material applied in the present invention contains the compound represented by General Formula (S) in at least one layer of silver halide emulsion layers.

In General Formula (S), the 5-membered heterocyclic ring represented by Q may include, for example, an imidazole ring, a tetrazole ring, a thiazole ring, an oxazole ring, a selenazole ring, a benzimidazole ring, a naphthoimidazole ring, a benzothiazole ring, a naphthothiazole ring, a benzoselenazole ring, a naphthoselenazole ring, a benzoxazole ring, etc., and the 6-membered heterocyclic ring represented by Q may include a pyridine ring, a pyrimidine ring, a quinoline ring, etc. These 5- or 6-membered heterocyclic ring may include those having a substituent.

The alkali metal atom represented by M may include a sodium atom, a potassium atom, atom, etc.

Of the compound represented by General Formula (S), particularly preferable compound can be represented by General Formula (SA) or General Formula (SB) shown below. General Formula (SA):

General Formula (SA)

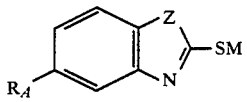

wherein $R_A$ represents a hydrogen atom, an alkyl group, an alkoxy group, an aryl group, a halogen atom, a carboxyl group or a salt thereof, a sulfo group or a salt thereof, or an amino group;

Z represents a group of —NH—, —O— or —S—; and

M has the same meaning with M in General Formula (S).

General Formula (SB):

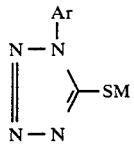

wherein Ar represents a group of;

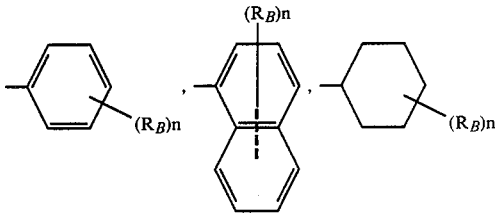

$R_B$ represents an alky group, an alkoxy group, a carboxyl group or a salt thereof, a sulfo group or a salt thereof, a hydroxyl group, an amino group, an acylamino group, a carbamoyl group, or a sulfonamide; n represents an integer of 0 to 2; and M has the same meaning with M in General Formula (S).

In General Formulas (SA) and (SB), the alkyl group represented by $R_A$ and $R_B$ may include, for example, a methyl group, an ethyl group, a butyl group, etc.; the alkoxy group may include, for example, a methoxy group, an ethoxy group, etc.; and the salt of the carboxyl group or sulfo group may include, for example, a sodium salt, an ammonium salt, etc.

In General Formula (SA), the aryl group represented by $R_A$ may include, for example, a phenyl group, a naphthyl group, etc.; and the halogen atom may include, for example, a chlorine atom, a bromine atom, etc.

In General Formula (SB), the acylamino group represented by $R_B$ may include, for example, a methylcarbonylamino group, a benzoylamino group, etc.; the carbamoyl group may include, for example, an ethyl-carbamoyl group, a phenyl carbamoyl group, etc.; and the sulfonamide group may include, for example, a methylsulfonamide group, a phenylsulfonamide, etc.

The above alkyl group, alkoxy group, aryl group, amino group, acylamino group, carbamoyl group, sulfonamide group, etc. may also contain those further having a substituent.

Typical examples of the compound represented by General Formula (S) are shown below.

S-1

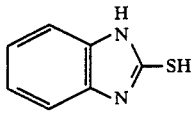

S-2

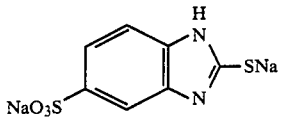

S-3

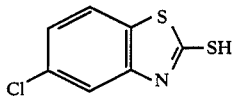

S-4

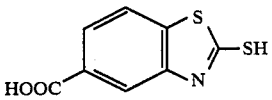

S-5

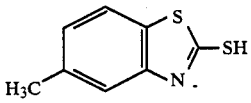

S-6

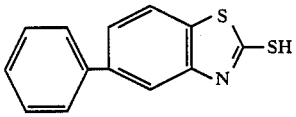

S-7

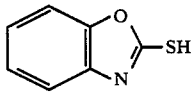

S-8

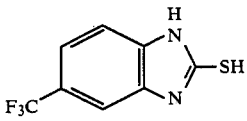

S-9

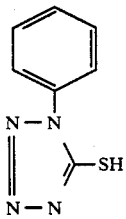

-continued

S-10

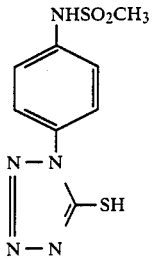

S-11

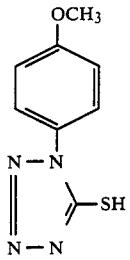

S-12

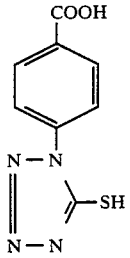

S-13

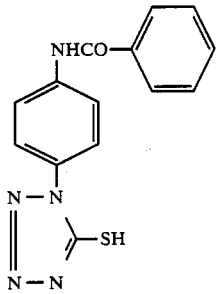

S-14

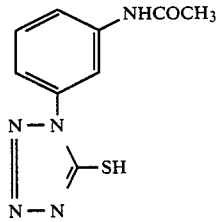

S-15

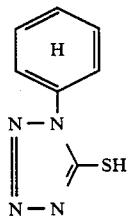

-continued

S-16

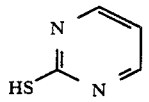

S-17

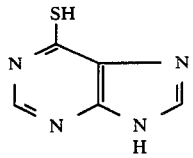

S-18

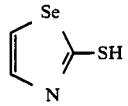

S-19

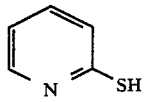

S-20

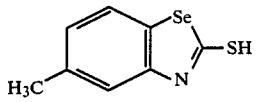

The compound represented by the above General Formula (S) may include, for example, the compounds disclosed in Japanese Patent Publication No. 28496/1965, Japanese Patent O.P.I. Publication No. 89034/1975, Journal of Chemical Society, 49, 1748 (1927), ditto 4237 (1952), Journal of Organic Chemistry, 39, 2469 (1965), U.S. Pat. No. 2,824,001, Journal of Chemical Society, 1723 (1951), Japanese Patent O.P.I. Publication No. 111846/1981, British Pat. No. 1,275,701, U.S. Pat. Nos. 3,266,897 and No. 2,403,927, etc., which can be synthesized according to the procedures also disclosed in these publications.

To incorporate the compound represented by General Formula (S) according to this invention (hereinafter "Compound (S)") into the silver halide emulsion layer of the present invention, it may be dissolved in water or in a freely water-miscible organic solvent (for example, methanol, ethanol, etc.), and then added. The compound (S) may be used alone or in combination with other compounds represented by General Formula (S) or any stabilizer or fog restrainer other than the compound represented by General Formula (S).

The compound (S) may be added at any time before formation of silver halide grains, during formation of silver halide grains, after completion of the formation of silver halide grains and before initiation of chemical ripening, during chemical ripening, at the time of completion of chemical ripening, or after completion of chemical ripening and before coating. Preferably, it may be added during chemical ripening, at the time of completion of chemical ripening, or after completion of chemical ripening and before coating. The addition may be carried out by adding the whole amount in one time, or by dividing it into several times.

As to the place for the addition, the compound may be added directly to a silver halide emulsion or a coating solution of the silver halide emulsion, or may be added to a coating solution for an adjacent non-light-sensitive hydrophilic colloid layer so that the compound may be contained in the silver halide emulsion layer of the present invention by the action of diffusion at the time of multi-layer coating.

There is no particular limitation in the amount for the addition, but the compound may be added usually in the range of $1\times10^{-6}$ mole to $1\times10^{-1}$, preferably $1\times10^{-5}$ to $1\times10^{-2}$.

The above Compound (S) according to the present invention may be applied in the system of the present invention, containing the silver halide grains having silver chloride content of 90 mole % or more, whereby there can be obtained the effect such that the rapid processing performance can be maintained, the minimum density of a dye image to be formed can be suppressed to a sufficiently lower degree, and also the variation of sensitometry due to the strength of the stirring of a color developing solution can be made small. This was found to be unexpected effect.

Silver halide grains having silver chloride content of 90 mole % or more are contained in the silver halide emulsion layer containing the above Compound (S) according to the present invention.

The silver halide grains of the present invention have silver chloride content of 90 mole % or more, and silver bromide content of preferably 10 mole % or less, and silver iodide content of 0.5 mole % or less. More preferably, the grains may comprise silver chlorobromide having silver bromide content of 0.05 to 5 mole %.

The silver halide grains may be used alone or as a mix with other silver halide grains having different composition. They may be also used as a mix with silver halide grains having silver chloride content of 10 mole % or less.

In the silver halide emulsion layer containing the silver halide grains of the present invention, having the silver chloride content of 90 mole % or more, the silver halide grains having the silver chloride content of 90 mole % or more may be held in the whole silver halide grains contained in said emulsion layer, in the proportion of 60% by weight or more, preferably 80% by weight or more.

The composition of the silver halide grains of the present invention may be homogeneous from inside to outside of a grain, or may be different between the inside and outside of a grain. In the case the composition is different between the inside and outside of a grain, the composition may vary continuously or discontinuously.

There is no particular limitation in the grain size of the silver halide grains of the present invention, but it may preferably range between 0.2 and 1.6 μm, more preferably 0.25 and 1.2 μm. The above grain size can be measured according to various methods generally used in the present technical field. A typical method is disclosed in Loveland, "Grain Size Analytical Method" (A.S.T.M. Symposium on Light Microscopy, pp. 94–122, 1955) or "The Theory of The Photographic Process" (by Meath and James, Third Edition, published by Macmillian Publishing Co., Inc., see Second Paragraph).

This grains size can be measured by use of a projection area or diametric approximate value of a grain. In the case the grains are substantially of uniform shape, the grain size distribution can be considerably precisely expressed as the diameter or the projection area.

The distribution of grain size of the silver halide grains of the present invention may be either polydisperse or monodisperse. The silver halide grains may preferably monodisperse silver halide grains having the variation coefficient in the grain size distribution of the silver halide grains, of 0.22 or less, more preferably 0.15 or less. Here, the variation coefficient is the coefficient showing the width of grain size distribution, and defined by the following equation:

$$\text{Variation coefficient } (S/r) = \frac{\text{Standard deviation of grain size distribution}}{\text{Average grain size}}$$

$$\text{Standard deviation } (S) \text{ of grain size distribution} = \sqrt{\frac{\Sigma (r - ri)^2 ni}{\Sigma ni}}$$

$$\text{Average grain size } (r) = \frac{\Sigma niri}{\Sigma ni}$$

Here, ri represents the grain size of the respective grains, and ni represents the number thereof. The grain size herein mentioned refers to its diameter in the case of a spherical silver halide grain, and, in the case of a cube or a grain having the shape other than a sphere, the diameter obtained by calculating its projected image to a circular image having the corresponding area.

The silver halide grains used in the emulsion of the present invention may be obtained by any of an acidic method, a neutral method and an ammoniacal method. The grains may be allowed to grow at one time, or grow after seed grains have been formed. The manner to prepare the seed grains and the manner to grow them may be same or different.

The manner to reacting a soluble silver salt with a soluble halogen salt may be any of a regular mixing method, a reverse mixing method and a simultaneous mixing method, or a combination of any of these, but preferred are grains formed by the simultaneous mixing method. As a type of the simultaneous mixing method, there can be used the pAg-controlled double jet method disclosed in Japanese Patent O.P.I. Publication No. 48521/1979.

If necessary, there may be further used a silver halide solvent such as thioether.

The silver halide grains according to the present invention that can be used may have any shape. A preferable example is a cube having {100} face as a crystal surface. Also, grains having the shape of octahedrons, tetradecahedrons, dodecahedrons, etc. may be prepared according to the procedure disclosed in the specifications of U.S. Pat. Nos. 4,183,756 and No. 4,225,666, Japanese Patent O.P.I. Publication No. 26589/1980, Japanese Patent Publication No. 42737/1980, etc., and the publications such as The Journal of Photographic Science, 21, 39 (1973), and these grains can be also used. There may be further used grains having a twin crystal face.

The silver halide grains according to the present invention that can be used may be grains comprising a single shape, or may be a mixture of grains having various shapes.

In the course of formation and/or growth of the silver halide grains used in the emulsion of the present invention, metal ions may be added to the grains by use of at least one of a cadmium salt, a zinc salt, a lead salt, a thallium salt, an iridium salt or a complex salt thereof, a rhodium salt or a complex salt thereof, and an iron salt or a complex salt thereof to incorporate any of these metal elements into the inside of the grains and/or the surface of the grains, and also a reduction sensitizing nuclei can be imparted to the inside of the grains and/or the surface of the grains by placing the grains in a suitable reductive atmosphere.

The emulsion containing the silver halide grains of the present invention (hereinafter "the emulsion of the present invention") may be either one from which unnecessary soluble salts have been removed after completion of the growth of silver halide grains, or one from which they remain unremoved. When the salts are removed, they can be removed according to the method disclosed in Research Disclosure No. 17643.

The silver halide grains used in the emulsion the present invention may be grains such that a latent image is chiefly formed on the surface, or grains such that it is formed chiefly in the inside of a grain. Preferred are the grains in which a latent image is chiefly formed on the surface.

The emulsion of the present invention can be chemically sensitized according to conventional methods. Namely, a sulfur sensitization method using a compound containing sulfur capable of reacting with silver ions, and active gelatin, a selenium sensitization method using a selenium compound, a reduction sensitization method using a reducing substance, and a noble metal sensitization method using noble metal compounds such as gold and so forth can be used alone or in combination.

In the present invention, a chalcogen sensitizer can be used as a chemical sensitizer. The chalgogen sensitizer is a general term for a sulfur sensitizer, a selenium sensitizer and a tellurium sensitizer. For photographic use, preferred are the sulfur sensitizer and the selenium sensitizer. The sulfur sensitizer may include, for example, thiosulfate, allythiocarbazide, thiourea, allylisothiocyanate, cystine, p-toluene thiosulfonate and rhodanine. Besides these, there can be also used the sulfur sensitizers disclosed in U.S. Pat. Nos. 1,574,944, 2,410,689, No. 2,278,947, No. 2,728,668, No. 3,501,313 and No. 3,656,955, German Laid-open Application (OLS) No. 14 22 866, Japanese Patent O.P.I. Publications No. 24937/1981 and No. 45016/1980, etc. The sulfur sensitizer may be added in an amount that may vary in a considerable range depending on the various conditions such as pH, temperature, size of silver halide grains, but, as a standard, preferably in an amount of $10^{-7}$ to $10^{-1}$ mole per mole of silver halide.

The selenium sensitizer can be used in place of the sulfur sensitizer, which selenium sensitizer may include isoselenocyanates such as allyisoselenocyanate, selenoureas, selenoketones, selenoamides, salts and esters of selenocarbonic acid, selenophosphates, and selenides such as diethyl selenide and diethyl diselenide. Examples of these are disclosed in U.S. Pats. No. 1,574,944, No. 1,602,592 and No. 1,623,499.

Reduction sensitization can be further used in combination. There is no particular limitation in a reducing agent, and it may include stannous chloride, thiourea dioxide, hydrazine, polyamine, etc.

Noble metal compounds other than gold, for example, palladium compounds or the like can be used in combination.

The silver halide grains according to the present invention may preferably contain a gold compound. The gold compound preferably usable in the present invention may any of gold having the oxidation number of valence +1 or +3, and various gold compounds may be used. Typical examples thereof may include chloroaurate, potassium chloroaurate, auric trichloride, potassium auric thiocyanate, potassium iodoaurate, tetracyanoauric azide, ammonium aurothiocyanate, pyridyl trichlorogold, gold sulfide, gold selenide, etc.

The gold compounds may be used in such a manner that it may sensitize the silver halide grains or may be used in such a manner that it may not substantially contribute to the sensitization.

The gold compound may be added in an amount that may vary depending on various conditions, but, as a standard, in an amount of $10^{-8}$ to $10^{-1}$ mole, preferably $10^{-7}$ to $10^{-2}$ mole. The compound may be added at any time, i.e., at the time of the formation of silver halide grains, at the time of physical ripening, at the time of chemical ripening, or after completion of the chemical ripening.

The emulsion of the present invention can be spectrally sensitized to a desired wavelength region with use of a dye known in the photographic field as a sensitizing dye. The sensitizing dye may be used alone, but may be used in combination of two or more ones.

Together with the sensitizing dye, the emulsion may contain a supersensitizing agent which is a dye having itself no action of spectral sensitization or a compound substantially absorbing no visible light, and that can strengthen the sensitizing action of the sensitizing dye.

Dye-forming couplers are used in the silver halide emulsion layer of the light-sensitive silver halide photographic material according to the present invention.

These dye-forming couplers may preferably have intramolecularly a group, called a ballast group, having 8 or more of carbon atoms, capable of making the couplers non-diffusible.

Yellow dye-forming couplers that can be preferably used may include acylacetoanilide type couplers. Of these, advantageous are benzoylacetoanilide type and pivaloylacetonitrile type compounds. Preferably, they include the compounds represented by General Formula (Y) shown below:

General Formula (Y):

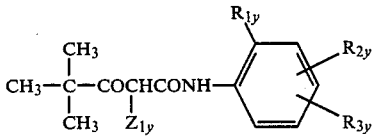

In the formula, $R_{1Y}$ represents a halogen atom or an alkoxy group. $R_{2Y}$ represents a hydrogen atom, a halogen atom, or an alkoxy group. $R_{3Y}$ represents an acylamino group, alkoxy carbonyl group, alkylsulfamoyl group, arylsulfamoyl group, arylsulfonamide group, alkylureido group, arylureido group, succinimide group, alkoxy group or aryloxy group. $Z_{1Y}$ represents a group eliminable through the coupling reaction with an oxidized product of a color developing agent.

Specific examples of usable yellow couplers are those disclosed in British Pat. No. 1,077,874, Japanese Patent Examined Publication No. 40757/1970, Japanese Patent O.P.I. Publications No. 1031/1972, No. 26133/1972, No. 94432/1973, No. 87650/1975, No. 3631/1976, No. 115219/1977, No. 99433/1979, NO. 133329/1979 and No. 30127/1981, U.S. Pat. Nos. 2,875,057, 3,253,924, 3,265,506, 3,408,194, 3,551,155, 3,511,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752, etc.

Magenta couplers that can be preferably used may include 5-pyrazolone type couplers, pyrazoloazole type couplers, etc. More preferably, they include the couplers represented by General Formula (P) or (aI) shown below.

General Formula (P)

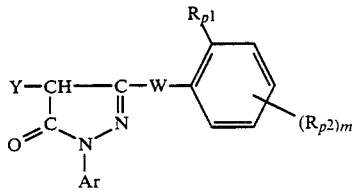

In the formula, Ar represents an aryl group; $R_{p1}$ represents a hydrogen atom or a substituent; and $R_{p2}$ represent a substituent. Y represents a group eliminable through the reaction with an oxidized product of a color developing agent; W represents —NH—, —NHCO—(where the nitrogen atom is attached to a carbon atom in the pyrazolone ring) or —NHCONH—; and m is an integer of 1 or 2.

General Formula (aI):

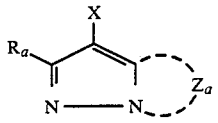

In the formula, $Z_a$ represent a group of non-metallic atoms necessary for the formation of a nitrogen-containing heterocyclic ring, and the ring to be formed by the $Z_a$ may have a substituent.

X represents a hydrogen atom or a substituent eliminable through the reaction with an oxidized product of a color developing agent.

$R_a$ represents a hydrogen atom or a substituent.

The substituent represented by the above $R_a$ may include, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbanoyl group, a sulfamoyl group, a cyano group, a spiro compound residual group, an organic hydrocabon compound residual group, an alkoxy group, an aryloxy group, a heterocyclic oxy group, a siloxy group, an acyloxy group, a corbamoyloxy group, an amino group, an acylamino group, a sulfonamide group, an imide group, an ureido group, a sulfamoylamino group, an alkoxycarbonylamino group. an aryloxycarbonylamino group, an alkoxy carbonyl group, an aryloxycarbonyl group, an alkylthio group, an arylthio group and a heteroxyclic thio group.

These are disclosed, for example, in U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500, Japanese Patent O.P.I. Publications No. 29639/1974, No. 111631/1974, No. 129538/1974, No. 13041/1975, No. 58922/1977, No. 62454/1980, No. 118034/1980, No. 38043/1981, No. 35858/1982 and No. 23855/1985, Brithish Pat. No. 1,247,493, Belgian Patent Nos. 769,116 and 792,525, West German Pat. No. 21 56 111, Japanese Patent Examined Publication No. 60479/1971, Japanese Patent O.P.I. Publications No. 125732/1984, No. 228252/1984, No. 162548/1984, No. 171956/1984, No. 33552/1985 and No. 43659/1985, West German Pat. No. 10 70 030, U.S. Pat. No. 3,725,067, etc.

Cyan dye-forming couplers to be used may include phenol type and naphtol type cyan dye-forming couplers. of these, preferably used are the couplers represented by General Formula (E) or (F) shown below.

General Formula (E):

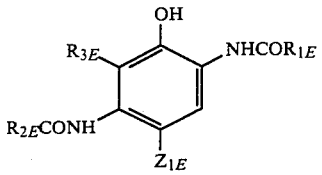

In the formula, $R_{1E}$ represents an aryl group, a cycloalkyl group or a heterocyclic group. $R_{2E}$ represents an alkyl group or a phenyl group. $R_{3E}$ represents a hydrogen atom, a halogen atom, an alkyl group or an alkoxy group. $Z_{1E}$ represents a hydrogen atom, a halogen atom or a group eliminable through the reaction with an oxidized product of an aromatic primary amine type color developing agent.

General Formula (F):

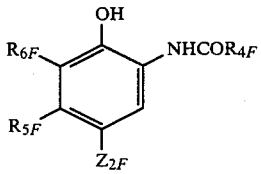

In the formula, $R_{4F}$ represents an alkyl group (for example, a methyl group, an ethyl group, a propyl group, a butyl group, a nonyl group, etc.). $R_{5F}$ represents an alkyl group, (for example, a methyl group, an ethyl group, etc.). $R_{6F}$ represents a hydrogen atom, a halogen atom (for example, fluorine, chlorine, bromine, etc.) or an alkyl group (for example, a methyl group, an ethyl group, etc.). $Z_{2F}$ represents a hydrogen atom, a halogen atom or a group eliminable through the reaction with an oxidized product of an aromatic primary amine type color developing agent.

These cyan dye-forming couplers are disclosed in U.S. Patent Nos. 2,306,410, 2,356,475, 2,362,598, 2,367,531, 2,369,929, 2,423,730, 2,474,293, 2,476,008, 2,498,466 2,545,687, 2,728,660, 2,772,162, 2,895,826, 2,976,146, 3,002,836, 3,419,390, 3,446,622, 3,476,563, 3,737,316, 3,758,308, and 3,839,044, British Pat. Nos. 478,991, No. 945,542, No. 1,084,480, No. 1,377,237, No. 1,388,024 and No. 1,543,040, Japanese Patent O.P.I. Publications No. 37425/1972, No. 10135/1975, No. 25228/1975, No. 112038/1975, No. 117422/1975, No. 130441/1975, No. 6551/1976, No. 37647/1976, No. 52828/1976, No. 108841/1976, No. 109630/1978, No. 48237/1979, No. 66129/1979, No. 131931/1979, No. 32071/1980, No. 146050/1984, No. 31953/1984 and No. 117249/1985, etc.

The dye-image forming couplers used in the present invention may be used in the respective silver halide emulsion layers usually in the range of $1\times10^{-3}$ mole to 1 mole, preferably $1\times10^{-2}$ mole to $8\times10^{-1}$ mole, per mole of silver halide.

Usually, the above dye-forming couplers may be added by dissolving the couplers in a high boiling organic solvent having a boiling point of 150° C. or more optionally together with a low boiling and/or water soluble organic solvent, and carrying out emulsification dispersion in a hydrophilic binder such as an aqueous gelatin solution by use of a surface active agent, followed by adding the dispersion to an intended hydrophilic colloid layer. There may be inserted a step of removing the dispersing solution or, at the same time of the dispersion, the low boiling organic solvent.

The high boiling organic solvent used in the present invention may include, for example, esters such as phthalic acid ester and phosphoric acid ester, organic amides, ketones, hydrocarbon compounds, etc.

The light-sensitive silver halide photographic material used in the present invention may include, for example, color negative films, color positive films, color photographic paper and so forth, but, in particular, the effect of the present invention can be effectively exhibited when used in the color photographic paper used for direct appreciation.

The light-sensitive silver halide photographic material of the present invention, including the color photographic paper, may be for use in monochrome or multicolor. In the case of the light-sensitive silver halide photographic material for multicolor photography, the light-sensitive material has usually such structure that silver halide emulsion layers containing magenta couplers, yellow couplers and cyan couplers, respectively, as couplers for photography are laminated on a support in a suitable number and order of the layers to effect subtractive color reproduction, but the number and order of the layers may be appropriately varied depending on what are important performances and what the materials are used for.

In the case the light-sensitive silver halide photographic material used in the present invention is a multicolor light-sensitive material, the specific layer constitution may be preferably such that a yellow dye image-forming layer, an intermediate layer, a magenta dye image-forming layer, an intermediate layer, and a protective layer are arranged in this order from the support side.

As a binder (or a protective colloid) used in the light-sensitive silver halide photographic material of the present invention, it is advantageous to use gelatin, but it is also possible to use hydrophilic colloids such as gelatin derivatives, a graft polymer of gelatin with other macromolecules, proteins, sugar derivatives, cellulose derivatives and synthetic hydrophilic high molecular substances such as homopolymer or copolymer.

Photographic emulsion layers and other hydrophilic colloid layers of the light-sensitive silver halide photographic material of the present invention can be hardened by using one or more kinds of hardening agents that can crosslink binder (or protective colloid) molecules to enhance the film strength. The hardening agents can be added in such an amount that a light-sensitive material can be hardened to the extent that no hardening agent is required to be added in a processing solution. It, however, is also possible to add the hardening agent in the processing solution.

In the present invention, to harden the silver halide emulsion layer, it is preferable to use a hardening agent of a chlorotriazine type, represented by General Formula (HDA) or (HDB) shown below.

General Formula (HDA):

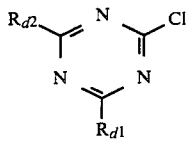

In the formula, $R_{d1}$ represents a chlorine atom, a hydroxyl group, an alkyl group, an alkoxy group, an alkylthio group, an —OM group (wherein M is a monovalent metal atom), an —NR'R" group (wherein R' and R" each represent a hydrogen atom, an alkyl group or an aryl group), or an —NHCOR''' (wherein R''' represents a hydrogen atom, an alkyl group or an aryl group); and $R_{d2}$ represents a group having the same meaning as the above $R_{d1}$, excluding a chlorine atom. General Formula (HDB):

General Formula (HDA):

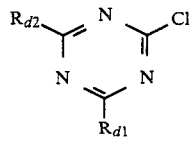

| Comp. No. | $R_{d1}$ | $R_{d2}$ |
|---|---|---|
| HD-1 | —OH | —ONa |
| HD-2 | —Cl | —ONa |
| HD-3 | —$OCH_3$ | —ONa |
| HD-4 | —Cl | —$OC_2H_5$ |
| HD-5 | —Cl | —OK |
| HD-6 | —OH | —OK |
| HD-7 | —Cl | —$NH_2$ |
| HD-8 | —Cl | —$NHCOCH_3$ |
| HD-9 | —OH | —$NHC_2H_5$ |

General Formula (HDB):

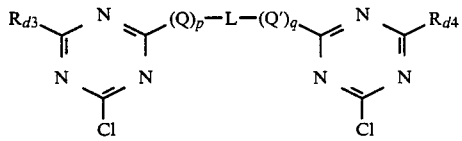

| Comp. No. | $R_{d3}$ | $R_{d4}$ | Q | p | Q' | q | L |
|---|---|---|---|---|---|---|---|
| HD-10 | —Cl | —Cl | O | 1 | O | 1 | 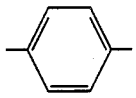 |
| HD-11 | —ONa | —ONa | O | 1 | O | 1 | —$CH_2CH_2$— |
| HD-12 | —ONa | —ONa | — | 0 | — | 0 | —$CH_2CH_2$— |
| HD-13 | —$OCH_3$ | —$OCH_3$ | S | 1 | S | 1 | —$CH_2CH_2$— |
| HD-14 | —ONa | —ONa | H —N— | 1 | H —N— | 1 | —$CH_2CH_2$— |
| HD-15 | —ONa | —ONa | H —N— | 1 | O | 1 | —$CH_2CH_2$— |

General Formula (HDB):

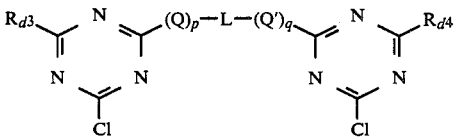

In the formula, $R_{d3}$ and $R_{d4}$ each represent a chlorine atom, a hydroxyl group, an alkyl group, an alkoxy group or an —OM group (wherein M is a monovalent metal atom). Q and Q' each represent a linking group showing —O—, —S—or —NH—; L represents an alkylene group or an arylene group; and p and q each represent 0 or 1.

Typical examples of the preferred hardening agent represented by the above General Formulas (HDA) and (HDB) are described below.

To add the hardening agent represented by General Formula (HDA) or (HDB) to silver halide emulsion layers and other constituent layers, it may be dissolved in water or a water-miscible solvent (for example, methanol, ethanol, etc.), and then the solution may be added to coating solutions for the above constituent layers. The addition may be carried out according to any of the batch system and the in-line system. There is no particular limitation in the time of the addition, but it may be preferably added immediately before coating.

These hardening agents may be added in an amount of 0.5 to 100 mg, preferably 2.0 to 50 mg, based on 1 g of gelatin to be coated.

A plasticizer can be added to the silver halide emulsion layers and/or other hydrophilic colloid layers of the light-sensitive silver halide photographic material used in the present invention (hereinafter referred to as the light-sensitive silver halide photographic material of the present invention), for the purpose of enhancing flexibility.

For the purpose of improving dimensional stability and the like, a dispersion (latex) of a water insoluble or hardly soluble synthetic polymer can be contained in the photographic emulsion layers and other hydrophilic colloid layers of the light-sensitive silver halide photographic material of the present invention.

An image stabilizing agent for preventing the deterioration of a dye image can be used in the light-sensitive silver halide photographic material of the present invention.

Hydrophilic colloid layer such as protective layers and intermediate layers of the light-sensitive silver halide photographic material of the present invention may contain an ultraviolet absorbent in order to prevent the fog due to the discharge caused by static charge by friction or the like of light-sensitive materials and prevent the deterioration due to ultraviolet light.

The light-sensitive silver halide photographic material of the present invention can be provided with auxiliary layer such as a filter layer, an anti-halation layer and an ant-irradiation layer. These layers and/or the emulsion layers may contain a dye that may be flowed out of the light-sensitive material, or bleached, during the development processing.

To the silver halide emulsion layers and/or other hydrophilic colloid layers of the light-sensitive silver halide photographic material of the present invention, a matte agent can be added for the purposes of decreasing the gloss of the light-sensitive material, improving the writing performance, and preventing mutual sticking of light-sensitive materials..

A lubricant can be added to the light-sensitive silver halide photographic material of the present invention, in order to decrease sliding friction.

An antistatic agent aiming at preventing static charge can be added to the light-sensitive silver halide photographic material of the present invention. The antistatic agent may be used in an antistatic layer provided on the side of a support at which no emulsion layer is laminated, or may be used in an emulsion layer and/or a protective colloid layer other than the emulsion layers provided on the side of a support on which emulsion layers are laminated.

In the photographic emulsion layers and/or other hydrophilic colloid layers of the light-sensitive silver halide photographic material of the present invention, a variety of surface active agents can be used for the purpose of improving coating performance, preventing static charge, improving slidability, emulsification dispersion, preventing adhesion, and improving photographic performances (such as development acceleration, hardening and sensitization).

The support used in the light-sensitive silver halide photographic material of the present invention can be applied on flexible reflective supports made of baryta paper, paper laminated with $\alpha$-olefin polymers or synthetic paper; films comprising semisynthetic or synthetic high molecular compounds such as cellulose acetate, cellulose nitrate, polystyrene, polyvinyl chloride, polyethylene terephthalate, polycarbonate and polyamide; rigid bodies such as glass, metals and ceramics; etc.

The light-sensitive silver halide photographic material of the present invention may be applied, as occasion calls, after having been subjected to corona discharging, ultraviolet irradiation, flame treatment and so forth, directly on the surface of the support or through interposition of one or more subbing layers for improving adhesion, antistatic performance, dimensional stability, abrasion resistance, hardness, anti-halation performance, friction characteristics and/or other characteristics of the surface of the support.

In the coating of the light-sensitive silver halide photographic material using the silver halide emulsion of the present invention, a thickening agent may be used in order to improve the coating performance. Particularly useful coating method may include extrusion coating and curtain coating by which two or more layers can be simultaneously coated.

The light-sensitive silver halide photographic material of this invention can be exposed by use of electromagnetic wave having the spectral region to which the emulsion layers constituting the light-sensitive material of the present invention have the sensitivity. As a light source, there can be used any known light sources including natural light (sunlight), a tungsten lamp, a fluroescent lamp, a mercury lamp, a xenon arc lamp, a carbon arc lamp, a xenon flash lamp, a cathode ray tube flying spot, every kind of laser beams, light from a light-emitting diode, light emitted from a fluorescent substance energized by electron rays, X-rays, gamma-rays, alpha-rays, etc.

As for the exposure time, it is possible to make exposure, not to speak of exposure of 1 millisecond to 1 second usually used in cameras, of not more than 1 microsecond, for example, 100 microseconds to 1 microsecond by use of a cathode ray tube or a xenon arc lamp, and it is also possible to make exposure longer than 1 second. Such exposure may be carried out continuously or may be carried out intermittently.

The light-sensitive silver halide photographic material used in the present invention, comprising the above silver halide grains having the silver chloride content of 90 mole % or more and Compound (S) of the present invention represented by General Formula (S), is processed by a color developing solution having a sulfite ion content of $2\times10^{-4}\times10^{-2}$ mole/lit and being substantially free from bromide ion.

Here, the solution "substantially free from bromide ion" is meant to be a processing solution containing only $5\times10^{-4}$ or less of bromide ions. In the present invention, the chloride-rich silver halide emulsion having the silver chloride content of 90 mole % or more as a silver halide is used, but this chloride-rich silver halide may also contain silver bromide and silver iodide in part in addition to the silver chloride, as mentioned above. For this reason, in the case the silver bromide is contained, bromide ions may slightly be dissolved out in the developing solution. It can be contemplated that this bromide ions thus dissolved out may be partially substituted to be retained in the light-sensitive silver halide photographic material and brought out to the next step, because of several figures of difference in the solubility with respect to the part other than the image portions, i.e., the chloride ions and silver within the chloride-rich silver halide that may not be developed even in the developing solution. However, as far as it is possible that the bromide ions, even though in a trace amount, may be dissolved out in the developing solution by the development of the chloride-rich silver halide as mentioned above, it is impossible to maintain perfectly to zero the bromide ion concentration in the developing solution. The words "substantially free from bromide ion" as used in the present invention is meant that no bromide ion is contained other than those which are inevitably included like the bromide ions dissolved out in a trace amount. The amount of $5\times10^{-4}$ mole/lit shows a maximum value for the concentration of the bromide ions inevitably included.

The color developing solution used in the present invention is substantially free from silver bromide ions, but the chloride ions are preferably present in a given amount. Namely, the chloride ions may be contained preferably in an amount of $1\times10^{-3}$ to 0.3 mole, more preferably $2\times10^{-3}$ to 0.2 mole, per 1 lit. of the color developing solution.

The color developing solution according to the present invention may have sulfite ion content of $2\times10^{-4}$ to $1\times10^{-2}$ mole/lit.

In the color developing step, an aromatic primary amine developing agent is generally used by dissolving it in an alkaline aqueous solution. Usually, the alkaline developing solution is unstable to oxidation, and sulfite ions are added as a preservation stabilization agent (or a preservative) for the purpose of preventing the oxidation. However, this sulfite ions are known to react with an oxidized product of a color developing agent to lower the color development efficiency. For this reason, Japanese Patent O.P.I. Publication No. 73955/1976, for example, discloses a technique to improve the color development by providing a condition that the sulfite ion concentration is decreased to not more than a particular amount. However, the present inventors have found that there can be obtained remarkable effect in the improvement in the color development performance under the condition of the decreased sulfite ions, and also can be obtained a most preferable result with the above particular, lower sulfite ion concentration range, when the light-sensitive material employing Compound (S) and the chloride-rich silver halide emulsion is processed by use of the color developing solution substantially free from bromide ion. In other words, the rapid color developing can not be achieved when the sulfite ion concentration is more than $1\times10^{-2}$ mole/lit, and, when it is less than $2\times10^{-4}$ mole/lit, no further improvement will not be seen even if it is further decreased, and moreover the minimum density (Dmin) may increase even in the presence of the development restrainer Compound (S) to seriously damage the photographic image quality. Thus, it was found that, in the system of extremely high color developing speed, in which the light-sensitive material containing the chloride-rich silver halide emulsion and the color developing solution substantially free from bromide ion is used, it can not always be satisfactory if only the sulfite ion concentration is simply decreased, and it is only in the above particular range that the minimum density can be sufficiently suppressed and at the same time the rapid processing performance can be achieved, satisfactorily.

To be more surprising, it was found that in the system of the present invention, i.e., in the system in which the light-sensitive silver halide photographic material containing the silver halide grains having silver chloride content of 90 mole % or more and Compound (S) of the present invention is processed by use of the color developing agent substantially free from bromide ion and containing sulfite ions in the particular range of $2\times10^{-4}$ to $1\times10^{-2}$ mole/lit, there can be had a great advantage from a view point of image stability, that the so-called stirring strength dependence, i.e., the sensitometry variation of a dye image, caused by the difference in the strength of stirring or degree of stirring in the color developing solution, can be made extremely small.

The sulfite ion concentration in the above color developing solution may be $2\times10^{-4}$ to $1\times10^{-2}$ mole/lit to achieve the object of the invention, but it may preferably be in the range of $3\times10^{-4}$ to $6\times10^{-3}$ mole/lit, more preferably $3\times10^{-4}$ to $3\times10^{-3}$ mole/lit.

The sulfite ions can be used in the form of, for example, an alkali metal sulfite, an alkali metal bisulfite, or an ammonium salt of sulfite or bisulfite. In order to maintain the sulfite ions to the above particular, lower concentration and also make stable the color developing solution, dihydroxyacetones disclosed in U.S. Pat. No. 3,615,503, hydroxyureas disclosed in Japanese Patent O.P.I. Publication No. 27638/1977, monosaccarides such as pentose, disclosed in Japanese Patent O.P.I. Publication No. 102727/1977, aromatic secondary alcohols disclosed in Japanese Patent O.P.I. Publication No. 7729/1977, etc. may be used in the color developing solution used in the present invention. The color developing solution may also be made stable and maintained to have the lower sulfite concentration, by employing a method in which replenishment is carried out in a large quantity in the color developing solution, a method in which a developing solution is made to be in the state of a closed system so as not to be in contact with air as far as possible, or a method in which a compound capable of keeping the sulfite ion concentration to a lower degree and also forming a sulfite ion adduct in an equilibrium condition is beforehand added in a developing solution.

The compound capable of forming a stable sulfite ion adduct with the sulfite ions may include, for example, a compound having an aldehyde group, a compound containing a cyclic hemiacetal, a compound having an alpha-dicarbonyl group, a compound having a nitrile group, etc.

The color developing agent used in the color developing solution in the present invention includes known ones widely used in the various color photographic processes. These developing agents include aminophenol type and p-phenylenediamine type derivatives. These compounds, which are more stable than in a free state, are used generally in the form of a salt, for example, in the form of a hydrochloride or a sulfate. Also, these compounds are used generally in concentration of about 0.1 to 30 g per 1 liter of a color developing solution, preferably in concentration of about 1 to 15 g per 1 liter of a color developing solution.

The aminophenol type developing agent may include, for example, o-aminophenol, p-aminophenol, 5-amino-2-oxytoluene, 2-amino-3-oxy-toluene, 2-oxy-3-amino-1,4-dimethyl-benzene, etc.

Most useful primary aromatic amine type color developing agent includes N,N'-dialkyl-p-phenylenediamine compound, wherein the alkyl group and the phenyl group may be substituted with any substituent. Of these, examples of particularly useful compounds may include N-N'-dimethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluene sulfonate, etc.

In addition to the above primary aromatic amine type color developing agent, the color developing agent used in the processing of the light-sensitive silver halide photographic material according to the present invention may also contain known compounds for developing solution components. For example, there may be optionally contained alkali agents such as sodium hydroxide, sodium carbonate and potassium carbonate, alkali metal thiocyanates, benzyl alcohol, water softening agents, thickening agents, etc.

This color developing solution may have usually the pH of 7 or more, most usually about 10 to 13.

The color development temperature may be usually 15° C. or more, and generally in the range of 20° C. to 50° C. For the rapid processing, the developing may be preferably carried out at 30° C. or more. The color development time may be preferably in the range of 20 seconds to 60 seconds, more preferably in the range of 30 seconds to 50 seconds.

The light-sensitive silver halide photographic material according to the present invention may contain the above color developing agent in hydrophilic colloid layers as a color developing agent itself or as a precursor thereof, and may be processed by use of an alkaline activated bath. The precursor of color developing agent is a compound capable of forming a color developing agent under the alkaline condition, and may include precursors of the type of a Schiff base with an aromatic aldehyde derivative, polyvalent metallic ion complex precursors, phthalic acid imide derivative precursors, phosphoric acid amide derivative precursors, sugar amine reaction product precursors, and urethane type precursors. These precursors of the aromatic primary amine color developing agents are disclosed, for example, in U.S. Pat. Nos. 3,342,599, 2,507,114, 2,695,234 and 3,719,492, British Pat. No. 803,783, Japanese Patent O.P.I. Publications No. 185628/1978 and No. 79035/1979, and Research Disclosures No. 15159, No. 12146 and No. 13924.

These aromatic primary amine color developing agents or the precursors thereof are required to be added in such an amount that a sufficient color development can be achieved only with the amount. This amount may considerably range depending on the type of light-sensitive materials, but, approximately, they may be used in the range of 0.1 mole to 5 moles, preferably 0.5 mole to 3 moles, per mole of silver halide. These color developing agents or the precursors thereof may be used alone or in combination. In order to incorporate them into a light-sensitive material, they can be added by dissolving them in a suitable solvent such as water, methanol, ethanol and acetone, can be added as an emulsification dispersion formed by using a high boiling organic solvent such as dibutyl phthalate, dioctyl phthalate and tricrezyl phosphate, or can be added by impregnating a latex polymer with them as disclosed in Research Disclosure No. 14850.

The light-sensitive silver halide photographic material of the present invention is subjected to bleaching and fixing after color developing. The bleaching may be carried out at the same time with the fixing. As a bleaching agent, there may be used various compounds, among which compounds of polyvalent metals such as iron (III), cobalt (III) and copper (II), particularly, complex salts of cations of these polyvalent metals with organic acids, for example, metal complex salts of aminopolycarboxylic acid such as ethylenediaminetetraacetic acid, nitrylotriacetic acid and N-hydroxyethyl ethylenediaminediacetic acid, malonic acid, tartaric acid, malic acid, diglycolic acid, dithioglycolic acid, etc., or ferricyanates, bichromate, etc. may be used alone or in combination.

As a fixing agent, there may be used a soluble complexing agent capable of solubilizing a silver halide as a complex salt. This soluble complexing agent may include, for example, sodium thiosulfate, ammonium thiosulfate, potassium thiocyanate, thiourea, thioether, etc.

After the fixing, washing with water is usually carried out. In place of the washing with water, stabilizing may be carried out, or both of them may be carried out in combination. A stabilizing solution used in the stabilizing may contain pH adjusters, chelating agents, mildewproofing agents, etc. Specific conditions for these are available by making reference to Japanese Patent O.P.I. Publication No. 134636/1983, etc.

According to the method of forming a dye image of the present invention having the constitution as described above, the minimum density of the dye image to be formed can be suppressed to a sufficiently lower level to achieve a superior rapid processing performance, and also can be small in the sensitometry variation due to the difference in the stirring conditions for a color developing solution to achieve superior stirring strength dependence.

The present invention will be described below by Examples in greater detail, but the working embodiments of the invention are by no means limited to these.

EXAMPLE 1

Preparation of silver halide emulsions

EMP-1:

An aqueous solution of silver nitrate and an aqueous solution of sodium chloride were added and mixed with stirring in an aqueous solution of inert gelatin according to a double jet method. Here, conditions were controlled to keep the temperature of 60° C. and the pH of 3.0 and pAg of 7.8. Subsequently, desalting was carried out according to a conventional method to obtain EMP-1. The EMP-1 was a cubic monodisperse silver chloride emulsion having an average grain size of 0.7 μm.

EMP-2:

An aqueous solution of silver nitrate and an aqueous solution of halides (an aqueous solution comprising a mixture of potassium bromide and sodium chloride) were added and mixed in an aqueous solution of inert gelatin according to a double jet method. Here, conditions were controlled to keep the temperature of 60° C. and the pH of 3.0 and pAg of 7.8 following the procedures disclosed in Japanese Patent O.P.I. Publication No. 45437/1984. Subsequently, desalting was carried out according to a conventional method to obtain EMP-2. The EMP-1 was a monodisperse emulsion comprising tetrahedral silver chlorobromide grains containing 90 mole % of silver bromide and having an average grain size of 0.7 μm.

Next, chemical sensitization was carried out on EMP-1 and EMP-2 under the conditions shown below, to prepare EMB-1 and EMB-2, respectively. However, Compound (S) was added at the time chemical ripening was completed. Sulfur sensitizing agent: Sodium thiosulfate

| | | |
|---|---|---|
| Sensitizing dye: | D-1 | 2.5 mg/mole AgX |
| Compound (S): | S-9 | 100 mg/mole AgX |
| Temperature: | 60° C. | $1.5 \times 10^{-3}$ mg/mole AgX |

-continued

| Time: | 60 minutes |
|---|---|

Sensitizing dye (D-1):

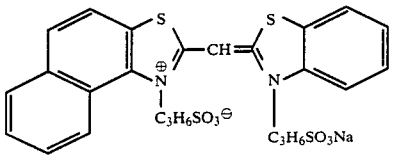

Next, a yellow coupler dispersion was prepared according to the method shown below.

[Method of dispersing yellow coupler]

In a mixed solvent comprising dibutyl phthalate in 10 ml and ethyl acetate, 40 g of yellow coupler (YC-1) were dissolved, and the solution obtained was added in an aqueous gelatine solution containing sodium dodecylbenzenesulfonate, followed by dispersion by use of an ultrasonic homogenizer.

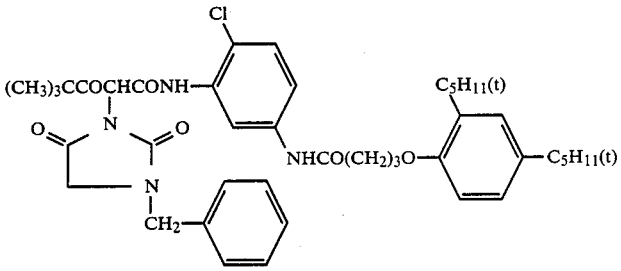

Subsequently, using the above EMB-1 and EMB-2, Light-sensitive materials [A] and [B] respectively were prepared to have the following constitution.

| | |
|---|---|
| Second layer: (Protective layer) | Gelatin (1.0 g/m$^2$)<br>HD-2 (20 mg/m$^2$) |
| First layer: (Emulsion layer) | Blue-sensitive emulsion (0.4 g/m$^2$ : calculated as silver)<br>Yellow coupler YC-1 (0.9 g/m$^2$)<br>Gelatin (1.5 g/m$^2$) |
| Support: | Polyethylene coated paper |

Yellow coupler was added in the form of the above coupler dispersion.

Using light-sensitive material [A] and light-sensitive material [B], the rapid processing performance and the stirring strength dependence were evaluated according to the following method.

[Evaluation of rapid processing performance]

Using KS-7 type photosensitometer (available from Konishiroku Photo Industry Co., Ltd.), exposure was effected through an optical wedge, followed by treatments shown below, wherein the processing time in the color developing step was set to three kinds of 20 seconds, 45 seconds and 90 seconds, and the composition of the color developing solution shown below was made to have four types of (A), (B), (C) and (D).

[Processing steps]

| | Temperature | Time |
|---|---|---|
| Color developing | 34.7 ± 0.3° C. | 20 sec, 45 sec, 90 sec |
| Bleach-fixing | 34.7 ± 0.5° C. | 45 sec |
| Stabilizing | 30 to 34° C. | 90 sec |
| Drying | 60 to 80° C. | 60 sec |

-continued

[Composition of color developing solution]

| | A | B | C | D |
|---|---|---|---|---|
| Pure water | 800 ml | 800 ml | 800 ml | 800 ml |
| Triethanolamine | 10 ml | 10 ml | 10 ml | 10 ml |
| N,N—diethylhydroxylamine | 5 g | 5 g | 5 g | 5 g |
| Potassium chloride | 2 g | 2 g | 2 g | 2 g |
| Potassium bromide | — | — | — | 0.1 g |
| Sodium sulfite | 2.0 g | 0.3 g | — | 0.3 g |
| N—ethyl-N—β-methanesulfonamidoethyl-3-methyl-4-aminoaniline sulfate | 5 g | 5 g | 5 g | 5 g |
| Sodium tetrapolyphosphate | 2 g | 2 g | 2 g | 2 g |
| Potassium carbonate | 30 g | 30 g | 30 g | 30 g |
| Brightening agent (a 4,4'-diaminostilbenedisulfonic) acid derivative | 1 g | 1 g | 1 g | 1 g |

YC-1:

Water was added to the components of each of A to D to make up the composition to 1 lit, and the pH was adjusted to 10.2 with use of sulfuric acid or potassium hydroxide.

(Bleach-fixing solution)

Ethylenediaminetetraacetic acid ferric ammonium dihydrate: 60 g

Ethylenediaminetetraacetic acid: 3 g

Ammonium thiosulfate (a 70% solution): 100 ml

Ammonium sulfite (a 40% solution): 27.5 ml

Adjusted to pH 7.4 with use of potassium carbonate or glacial acetic acid, and made up to 1 lit as a whole by adding water.

(Stabilizing solution)

5-Chloro-2-methyl-4-isothiazolin-3-on: 1 g

1-Hydroxyethylidene-1,1-diphosphonic acid: 2 g

Made up to 1 lit by adding water, and adjusted to pH 7.0 with use of sulfuric acid or potassium hydroxide.

On the samples obtained, reflection density was measured with use of a densitometer (PDA-65; available from Konishiroku Photo Industry, Co., Ltd.) to find the characteristic values as defined below.

Gradation (γ): Inclination of a straight line connecting the density 0.5 and the density 1.5 in the characteristic curve.

Minimum density (Dmin): Density at a non-image portion.

Results are shown in Table 1 (1*a* and 1*b*). In Table 1, the lower the Dmin is, and the more sufficient the value γ is, and also the smaller the change in the characteristic values is between the steps of the color developing time, the better the rapid processing performance is judged to have been achieved.

[Evaluation of stirring strength dependence]

Exposure, processing and density measurement were carried out in the same manner as in the evaluation on the rapid processing performance, except that the color developing time was set to 45 seconds and the stirring was carried out under the conditions (I) and (II) set out below.

Stirring condition (I): Stirred in a color developing solution at intervals of once a second.

Stirring condition (II): Stirred in a color developing solution at intervals of once in 15 seconds.

The stirring was carried out by moving samples upward and downward in the processing solution, and one stroke for the upward and downward moving was assumed to be one time. The stirring strength dependence is represented by the difference ($\Delta\gamma$) in the value $\gamma$ in the above Conditions (I) and (II). The smaller the value $\gamma$ is, the more preferably smaller the stirring strength dependency is judged to be.

TABLE 1a

| Test No. | Light-sensitive material | Blue sensitive emulsion layer: Emulsion number | Blue sensitive emulsion layer: Silver chloride content (mole %) | Color developing solution |
|---|---|---|---|---|
| 1-1 (X) | [A] | EMB-1 | 100 | (A) |
| 1-2 (Y) | [A] | EMB-1 | 100 | (B) |
| 1-3 (X) | [A] | EMB-1 | 100 | (C) |
| 1-4 (X) | [A] | EMB-1 | 100 | (D) |
| 1-5 (X) | [B] | EMB-2 | 10 | (A) |
| 1-6 (X) | [B] | EMB-2 | 10 | (B) |
| 1-7 (X) | [B] | EMB-2 | 10 | (C) |
| 1-8 (X) | [B] | EMB-2 | 10 | (D) |

X: Comparative example
Y: Present invention

TABLE 1b

| Test No. | Dmin 20 sec | Dmin 45 sec | Dmin 90 sec | $\gamma$ 20 sec | $\gamma$ 45 sec | $\gamma$ 90 sec | SSD* ($\Delta\gamma$) |
|---|---|---|---|---|---|---|---|
| 1-1 | 0.05 | 0.05 | 0.05 | 2.18 | 3.09 | 3.58 | 0.77 |
| 1-2 | 0.04 | 0.05 | 0.05 | 3.00 | 3.56 | 3.59 | 0.28 |
| 1-3 | 0.05 | 0.07 | 0.08 | 3.02 | 3.50 | 3.59 | 0.69 |
| 1-4 | 0.04 | 0.05 | 0.06 | 1.83 | 2.84 | 3.46 | 0.37 |
| 1-5 | 0.04 | 0.05 | 0.06 | 1.28 | 2.28 | 3.08 | 0.38 |
| 1-6 | 0.04 | 0.05 | 0.06 | 1.38 | 2.36 | 3.14 | 0.39 |
| 1-7 | 0.04 | 0.05 | 0.06 | 1.45 | 2.40 | 3.20 | 0.41 |
| 1-8 | 0.04 | 0.04 | 0.05 | 1.31 | 2.29 | 3.10 | 0.42 |

*SSD: Stirring strength dependence

As will be clear from Table 1 (1*a* and 1*a*), the rapid processing performance is fundamentally not satisfactory in respect of the comparative Experiments 1-5 to 1-8 in which silver chlorobromide having lower silver chloride content is used. In the samples having higher silver chloride content, the rapid processing performance is also unsatisfactory when processed with use of a color developing solution containing bromide ions in an amount more than that defined in the present invention (see comparative Experiment 1-4). Similarly, the rapid processing performance does not reach a satisfactory level, when processed in a color developing solution containing sulfite ions in an amount more than that defined in the present invention (see comparative Experiment 1-1), and, on the other hand, when processed in a color developing solution containing no sulfite ion at all (comparative Experiment 1-3), there is observed an increase in the minimum density although the rapid processing performance can be satisfactory. Any of these samples have a problem. In contrast to these, both the rapid processing performance and the minimum density were satisfactory in Experiment 1-2 according to the present invention. As for the stirring strength dependence, it does not rise to a level to be seriously questioned in respect of the comparative Experiments 1-5 to 1-8 employing conventional silver chlorobromide grains, and also it is at substantially the same level in respect of the comparative Experiment 1-4 in which the processing is carried out using silver chloride grains in a developing solution containing bromide ions. However, the stirring strength dependence is greatly inferior in respect of both Experiment 1-1 in which the processing is carried out using silver chloride grains in a developing solution containing sulfite ions in an amount more than that defined in the present invention, and Experiment 1-3 in which the processing is carried out in a developing solution containing no sulfite ion at all. In contrast to these, surprisingly very good results are obtained in Experiment 1-2.

EXAMPLE 2

Under the conditions shown below, chemical ripening was carried out on EMP-1 prepared in Example 1 to obtain EMR-1 to EMR-7 and EMR-15 to EMR-20.

| | |
|---|---|
| Sulfur sensitizing agent: | Sodium thiosulfate 2.5 mg/mole AgX |
| Sensitizing dye: | D-2 40 mg/mole AgX |
| Chloroaurate: | (Conditions as shown in Table 2a) |
| Compound (S): | (Conditions as shown in Table 2a) |
| Temperature: | 55° C. |

The sensitizing dye, chloroaurate, and Compound (S) were added 5 minutes after the addition of sodium thiosulfate, 60 minutes after the addition of sodium thiosulfate and 70 minutes after the addition of sodium thiosulfate, respectively, and the chemical ripening was terminated with the addition of Compound (S).

(D-2)

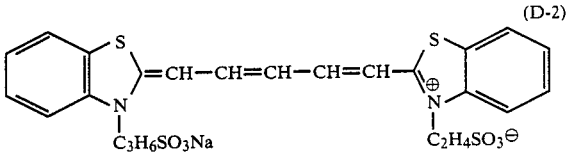

Next, in the same manner for EMP-2 in Example 1, prepared was a monodisperse emulsions EMP-3 and EMP-4 comprising cubic silver chlorobromide grains having an average particle size of 0.5 μm and respectively containing 2.0 mole % (EMP-3) and 0.04 mole % (EMP-4) of silver bromide.

On this EMP-3 and EMP-4 chemical ripening was carried out under the same conditions for the cases of EMR-k to EMR-7 to obtain EMR-8 to EMR-14 and EMR-15 to EMR-21, respectively.

Next, a cyan coupler dispersion was prepared according to the method shown below.

[Method of dispersing cyan coupler]

In a mixed solvent comprising dibutyl phthalate in 10 ml and ethyl acetat, 40 g of cyan coupler (CC-1) were dissolved, and the solution obtained was added in an aqueous gelatin solution containing sodium docecylbenzenesulfonate, followed by dispersion by use of an ultrasonic homogenizer.

CC-1:

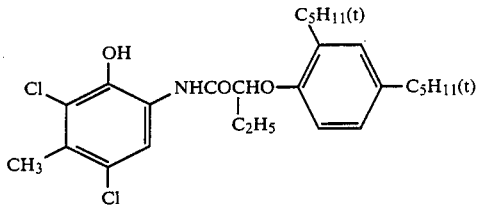

Subsequently, using the above coupler dispersion and the above EMR-1 to EMR-27, Samples 2-1 to 2-27 were prepared to have the following constitution.

| | |
|---|---|
| Second layer: (Protective layer) | Gelatin (1.0 g/m$^2$)<br>HD-2 (20 mg/m$^2$) |
| First layer: (Emulsion layer) | Red-sensitive emulsion (0.25 g/m$^2$: calculated as silver)<br>Cyan coupler CC-1 (0.3 g/m$^2$)<br>Gelatin (1.5 g/m$^2$) |
| Support: | Polyethylene coated paper |

In the above Samples 2-1 to 2-27, the rapid processing performance and the stirring strength dependence were evaluated according to the same method as in Example 1, provided that only the color development solution having the composition of [B] was used. Results are shown in Table 2*b*.

Compounds (SC-1) and (SC-2) used in Table 2*a* which are compounds comparative to Compound (S) have the following structure.

SC-1:

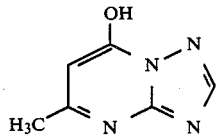

SC-2:

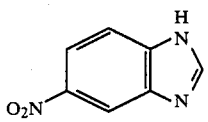

TABLE 2a

| Sample No. | Emulsion | Silver chloride content (mole %) | Compound [S] | Chloroaurate (mol/mol AgX) |
|---|---|---|---|---|
| 2-1 (X) | EMR-1 | 100 | SC-1 | — |
| 2-2 (X) | EMR-2 | 100 | SC-2 | — |
| 2-3 (Y) | EMR-3 | 100 | S-1 | — |
| 2-4 (Y) | EMR-4 | 100 | S-5 | — |
| 2-5 (Y) | EMR-5 | 100 | S-11 | — |
| 2-6 (Y) | EMR-6 | 100 | S-14 | — |
| 2-7 (Y) | EMR-7 | 100 | S-14 | $5 \times 10^{-5}$ |
| 2-8 (X) | EMR-8 | 98.0 | SC-1 | — |
| 2-9 (X) | EMR-9 | 98.0 | SC-2 | — |
| 2-10 (Y) | EMR-10 | 98.0 | S-1 | — |
| 2-11 (Y) | EMR-11 | 98.0 | S-5 | — |
| 2-12 (Y) | EMR-12 | 98.0 | S-11 | — |
| 2-13 (Y) | EMR-13 | 98.0 | S-14 | — |
| 2-14 (Y) | EMR-14 | 98.0 | S-14 | — |

TABLE 2a'

| Sample No. | Emulsion | Silver chloride content (mole %) | Compound [S] | Chloroaurate (mol/mol AgX) |
|---|---|---|---|---|
| 2-15 (X) | EMR-15 | 99.6 | SC-1 | — |

TABLE 2a'-continued

| Sample No. | Emulsion | Silver chloride content (mole %) | Compound [S] | Chloroaurate (mol/mol AgX) |
|---|---|---|---|---|
| 2-16 (X) | EMR-16 | 99.6 | SC-2 | — |
| 2-17 (Y) | EMR-17 | 99.6 | S-1 | — |
| 2-18 (Y) | EMR-18 | 99.6 | S-5 | — |
| 2-19 (Y) | EMR-19 | 99.6 | S-11 | — |
| 2-20 (Y) | EMR-20 | 99.6 | S-14 | — |
| 2-21 (Y) | EMR-21 | 99.6 | S-14 | $5 \times 10^{-5}$ |
| 2-22 (Y) | EMR-22 | 100 | S-2 | — |
| 2-23 (Y) | EMR-23 | 100 | S-6 | — |
| 2-24 (Y) | EMR-24 | 100 | S-8 | — |
| 2-25 (Y) | EMR-25 | 100 | S-12 | — |
| 2-26 (Y) | EMR-26 | 100 | S-17 | — |
| 2-27 (Y) | EMR-27 | 100 | S-20 | — |

X: Comparative example
Y: Present invention

TABLE 2b

| Sample No. | Dmin 20 sec | Dmin 50 sec | Dmin 80 sec | γ 20 sec | γ 50 sec | γ 80 sec | SSD* (Δγ) |
|---|---|---|---|---|---|---|---|
| 2-1 | 0.08 | 0.29 | 0.66 | 3.07 | 3.68 | 3.70 | 0.47 |
| 2-2 | 0.07 | 0.22 | 0.53 | 2.96 | 3.64 | 3.67 | 0.51 |
| 2-3 | 0.05 | 0.06 | 0.06 | 3.02 | 3.67 | 3.69 | 0.31 |
| 2-4 | 0.05 | 0.06 | 0.06 | 3.10 | 3.69 | 3.72 | 0.28 |
| 2-5 | 0.05 | 0.06 | 0.06 | 3.07 | 3.62 | 3.66 | 0.29 |
| 2-6 | 0.05 | 0.06 | 0.06 | 3.05 | 3.64 | 3.67 | 0.28 |
| 2-7 | 0.04 | 0.04 | 0.05 | 3.39 | 3.70 | 3.72 | 0.25 |
| 2-8 | 0.08 | 0.28 | 0.65 | 3.04 | 3.57 | 3.60 | 0.42 |
| 2-9 | 0.07 | 0.22 | 0.53 | 3.00 | 3.62 | 3.64 | 0.49 |
| 2-10 | 0.04 | 0.05 | 0.05 | 3.04 | 3.58 | 3.61 | 0.22 |
| 2-11 | 0.04 | 0.05 | 0.05 | 3.08 | 3.61 | 3.64 | 0.19 |
| 2-12 | 0.04 | 0.05 | 0.05 | 3.07 | 3.58 | 3.60 | 0.20 |
| 2-13 | 0.04 | 0.05 | 0.05 | 3.05 | 3.60 | 3.63 | 0.18 |
| 2-14 | 0.03 | 0.03 | 0.04 | 3.32 | 3.65 | 3.67 | 0.15 |

TABLE 2b'

| Sample No. | Dmin 20 sec | Dmin 50 sec | Dmin 60 sec | γ 20 sec | γ 50 sec | γ 60 sec | SSD* (Δγ) |
|---|---|---|---|---|---|---|---|
| 2-15 | 0.08 | 0.31 | 0.71 | 3.11 | 3.59 | 3.61 | 0.45 |
| 2-16 | 0.08 | 0.25 | 0.55 | 3.13 | 3.60 | 3.63 | 0.48 |
| 2-17 | 0.03 | 0.04 | 0.04 | 3.18 | 3.65 | 3.65 | 0.16 |
| 2-18 | 0.03 | 0.04 | 0.04 | 3.14 | 3.64 | 3.63 | 0.17 |
| 2-19 | 0.04 | 0.04 | 0.05 | 3.03 | 3.55 | 3.57 | 0.19 |
| 2-20 | 0.04 | 0.04 | 0.05 | 3.07 | 3.60 | 2.62 | 0.19 |
| 2-21 | 0.03 | 0.04 | 0.03 | 3.37 | 3.67 | 3.66 | 0.13 |
| 2-22 | 0.05 | 0.06 | 0.06 | 3.05 | 3.68 | 3.70 | 0.30 |
| 2-23 | 0.05 | 0.06 | 0.06 | 3.02 | 3.68 | 3.67 | 0.27 |
| 2-24 | 0.05 | 0.06 | 0.06 | 3.12 | 3.70 | 3.72 | 0.28 |
| 2-25 | 0.05 | 0.06 | 0.06 | 3.07 | 3.67 | 3.70 | 0.26 |
| 2-26 | 0.06 | 0.07 | 0.08 | 2.92 | 3.65 | 3.61 | 0.32 |
| 2-27 | 0.06 | 0.07 | 0.09 | 2.98 | 3.68 | 3.63 | 0.35 |

*SSD: Stirring strength dependence

As will be clear from Tables 2*a* and 2*b*, even when the color developing solution according to the present invention is used, the minimum density extremely rise and the stirring strength dependence is also at a problematic level in respect of Samples 2-1, 2-2, 2-8, 2-9, 2-15 and 2-16 employing the compound comparative to Compound (S) of the present invention. In contrast thereto, the minimum density is suppressed to a sufficiently low degree, the rapidly processing performance can be satisfactory, and also the stirring strength dependence is very good, in respect of all Samples 2-3 to 2-7, 2-10 to 2-17 to 2-27 employing Compound (S) according to the present invention. Making review in greater detail, the addition of a gold compound makes it possible to efficiency achieve the effect of the present invention on the decreased minimum density, the rapid processing performance and the stirring strength dependence, and also the employment of the silver halide grains containing a trace amount of silver bromide and having a high silver chloride content can more decrease the minimum density and more improve the stirring strength dependence.

EXAMPLE 3

On emulsions EMP-1 to EMP-4 prepared in Examples 1 and 2, chemical ripening was applied under the conditions shown below to obtain EM-1 to EM-12. The addition of the sensitizing dye, chloroaurate and Compound (S) was carried out under the same conditions as in Example 2.

| Emulsion No. | Unsensitized emulsion | Sensitizing dye | Silver chloride content | Chloroaurate (mol/molAgX) | Compound (S) |
|---|---|---|---|---|---|
| EM-1 | EMP-2 | D-1 | 10 | $1 \times 10^{-5}$ | SC-1 |
| EM-2 | EMP-1 | D-1 | 100 | $1 \times 10^{-5}$ | SC-1 |
| EM-3 | EMP-1 | D-1 | 100 | $1 \times 10^{-5}$ | S-3 |
| EM-4 | EMP-1 | D-1 | 100 | $1 \times 10^{-5}$ | S-15 |
| EM-5 | EMP-2 | D-3 | 10 | $8 \times 10^{-5}$ | SC-1 |
| EM-6 | EMP-14 | D-3 | 99.6 | $8 \times 10^{-5}$ | SC-1 |
| EM-7 | EMP-14 | D-3 | 99.6 | $8 \times 10^{-5}$ | S-3 |
| EM-8 | EMP-14 | D-3 | 99.6 | $8 \times 10^{-5}$ | S-15 |
| EM-9 | EMP-2 | D-2 | 10 | $5 \times 10^{-5}$ | SC-1 |
| EM-10 | EMF-3 | D-2 | 98 | $5 \times 10^{-5}$ | SC-1 |
| EM-11 | EMP-3 | D-2 | 98 | $5 \times 10^{-5}$ | S-3 |
| EM-12 | EMP-3 | D-2 | 98 | $5 \times 10^{-5}$ | S-15 |

Temperature: 55° C.

Sulfur sensitizing agent: Sodium thiosulfate, 2 mg/mol AgX

Next, using the above EM-1 to EM-12, Samples 3-1 to 3-8 were prepared with the constitution shown in Table 3 and under the conditions shown in Table 4*a*, provided that the hardening agent shown in Table 4*a* was added to the seventh layer.

TABLE 3

| Layer | Constitution |
|---|---|
| Seventh layer | Gelatin (1.0 g/m$^m$) |
| Sixth layer | Ultraviolet absorbent (UV-1, 0.3 g/m$^2$)<br>Gelatin (0.7 g/m$^2$) |

TABLE 3-continued

| Layer | Constitution |
|---|---|
| Fifth layer | Red-sensitive silver chlorobromide emulsion (coated silver amount 0.25 g/m$^2$)<br>Cyan coupler (CC-1, 0.3 g/m$^2$)<br>Dibutyl phthalate (0.2 g/m$^2$)<br>Gelatin (1.0 g/m$^2$) |
| Fourth layer | Ultraviolet absorbent (UV-1, 0.7 g/m$^2$)<br>Gelatin (1.3 g/m$^2$) |
| Third layer | Green-sensitive silver chlorobromide emulsion (coated silver amount, 0.18 g/m$^2$)<br>Magenta coupler (MC-1, 0.4 g/m$^2$)<br>Dibutyl phthalate (0.2 g/m$^2$)<br>Gelatin (1.5 g/m$^2$) |
| Second layer: | Gelatin (1.0 g/m$^2$) |
| First layer: | Blue-sensitive silver chlorobromide emulsion (coated silver amount, 0.40 g/m$^2$)<br>Yellow coupler (YC-1, 0.9 g/m$^2$)<br>Dibutyl phthalate (0.03 g/m$^2$)<br>Gelatin (2.0 g/m$^2$) |
| Support: | Polyethylene coated paper |

Ultraviolet absorbent (UV-1):

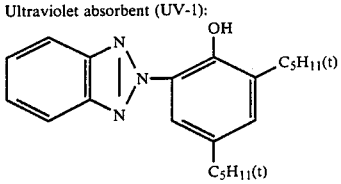

The rapid processing performance and stirring strength dependence were evaluated on Samples 3-1 to 3-8 in the same manner as in Example 1. Results obtained are shown in Tables 4*b* and 4*c*, wherein data for the developing time of 45 seconds only are shown in respect of Dmin.

Magenta Coupler (MC-1):

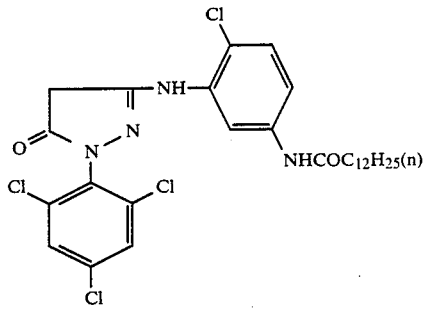

Sensitizing dye (D-3):

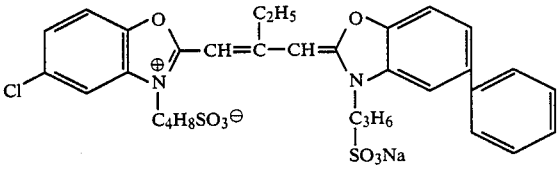

TABLE 4a

| Sample No. | silver halide emulsion 1st layer | 3rd layer | 5th layer | Hardening agent (g/m$^2$) |
|---|---|---|---|---|
| 3-1 (X) | EM-1 | EM-5 | EM-9 | HC-1 (0.15) |
| 3-2 (X) | EM-2 | EM-6 | EM-10 | HC-1 (0.15) |
| 3-3 (Y) | EM-3 | EM-7 | EM-11 | HC-1 (0.15) |
| 3-4 (Y) | EM-4 | EM-8 | EM-12 | HC-1 (0.15) |
| 3-5 (X) | EM-1 | EM-5 | EM-9 | HD-2 (0.08) |

TABLE 4a-continued

| Sample No. | silver halide emulsion 1st layer | 3rd layer | 5th layer | Hardening agent ($g/m^2$) |
|---|---|---|---|---|
| 3-6 (X) | EM-2 | EM-6 | EM-10 | HD-2 (0.08) |
| 3-7 (Y) | EM-3 | EM-7 | EM-11 | HD-2 (0.08) |
| 3-8 (Y) | EM-4 | EM-8 | EM-12 | HD-2 (0.08) |

HC-1: Bis(vinylsulfonylmethyl)ether
X: Comparative example
Y: Present invention

TABLE 4b

| Sample No. | γ Y 20 sec | Y 45 sec | Y 90 sec | M 20 sec | M 45 sec | M 90 sec | C 20 sec | C 45 sec | C 90 sec |
|---|---|---|---|---|---|---|---|---|---|
| 3-1 | 1.20 | 2.14 | 3.09 | 1.85 | 2.64 | 3.48 | 1.78 | 2.57 | 3.39 |
| 3-2 | 2.65 | 3.31 | 3.37 | 3.05 | 3.52 | 3.54 | 3.24 | 3.64 | 3.68 |
| 3-3 | 2.61 | 3.40 | 3.41 | 3.27 | 3.27 | 3.57 | 3.30 | 3.64 | 3.65 |
| 3-4 | 2.59 | 3.34 | 3.40 | 3.15 | 3.55 | 3.58 | 3.21 | 3.59 | 3.63 |
| 3-5 | 1.18 | 2.16 | 3.03 | 1.89 | 2.70 | 3.47 | 1.80 | 2.56 | 3.41 |
| 3-6 | 2.67 | 3.32 | 3.39 | 3.11 | 3.55 | 3.53 | 3.24 | 3.66 | 3.69 |
| 3-7 | 2.66 | 3.31 | 3.40 | 3.34 | 3.62 | 3.62 | 3.20 | 3.56 | 3.58 |
| 3-8 | 2.58 | 3.36 | 3.42 | 3.35 | 3.60 | 3.61 | 3.21 | 3.57 | 3.60 |

TABLE 4c

| Sample No. | Dmin Y 45 sec | M 45 sec | C 45 sec | Stirring strength dependence (Δγ) Y | M | C |
|---|---|---|---|---|---|---|
| 3-1 | 0.14 | 0.33 | 0.28 | 0.25 | 0.26 | 0.29 |
| 3-2 | 0.28 | 0.50 | 0.38 | 0.34 | 0.43 | 0.48 |
| 3-3 | 0.05 | 0.05 | 0.05 | 0.10 | 0.15 | 0.13 |
| 3-4 | 0.05 | 0.06 | 0.05 | 0.11 | 0.19 | 0.15 |
| 3-5 | 0.13 | 0.31 | 0.28 | 0.24 | 0.26 | 0.28 |
| 3-6 | 0.26 | 0.48 | 0.38 | 0.33 | 0.43 | 0.45 |
| 3-7 | 0.44 | 0.04 | 0.04 | 0.07 | 0.12 | 0.10 |
| 3-8 | 0.04 | 0.04 | 0.04 | 0.08 | 0.10 | 0.09 |

As will be clear from Tables 4*a* to 4*c*, any of the rapid processing performance and minimum density are unsatisfactory and also the stirring strength dependence is at a problematic level in respect of Samples 3-1 and 3-5 in which the silver chloride content is outside the present invention. In respect of Samples 3-2 and 3-6 employing the compounds comparative to Compound (S), the rapid processing performance can be satisfactory, but the minimum density and stirring strength dependence are remarkably inferior. In contrast thereto, superior characteristics are shown for any of the rapid processing performance and minimum density and also the stirring strength dependency is greatly improved, in respect of Samples 3-3, 3-4, 3-7 and 3-8 which are in accordance with the present invention. Making view in greater detail, it is seen that the effect of the present invention can be more efficiently achieved by using a trichlorotriazine type compound as a hardening agent.

What is claimed is:

1. A method of forming a dye image comprising a step of imagewise exposing a light-sensitive silver halide photographic material which comprises a support and, provided thereon, at least one silver halide emulsion layer, said silver halide emulsion layer containing silver halide grains containing 90 mole % or more of silver chloride, a dye-forming coupler and a compound represented by general formula;

[S]

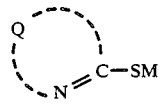

wherein Q is a group of atoms necessary to complete a 5- or 6-membered heterocyclic ring or a 5- or 6-membered ring fused with a benzene ring and M is a hydrogen atom, an alkali metal or an ammonium group; and said silver halide emulsion layer having been hardened by a hardener represented by formula [HDA] or [HDB];

[HDA]

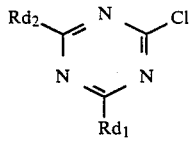

wherein Rd, is selected from the group consisting of a chlorine atom, a hydroxyl group, an alkyl group, an alkoxy group, an alkylthio group, an -OM group, wherein M is an mono-valent metal atom, a -NR'R" group, wherein R' and R" are independently selected from the group consisting of a hydrogen atom, an alkyl group and an aryl group and a —NHCOR''' group, in which R''' is selected from the group consisting of a hydrogen atom, an alkyl group and an aryl group; $Rd_2$ is selected from the group consisting of a hydroxyl group, an alkyl group, an alkoxy group, an alkylthio group, an -OM group, wherein M is an mono-valent metal atom, a -NR'R" group, wherein R' and R" are independently selected from the group consisting of a hydrogen atom, an alkyl group and an aryl group and a —NHCOR''' group, in which R''' is selected from the group consisting of a hydrogen atom, an alkyl group and an aryl group;

[HDB]

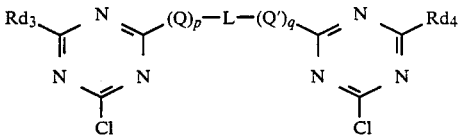

wherein $Rd_3$ and $Rd_4$ are independently selected from the group consisting of a chlorine atom, a hydroxyl group, an alkyl group, an alkoxy group and an -OM group, in which is a mono valent metal atom; Q and Q' is a divalent atom or group selected from —O—, —S— and —NH—; L is an alkylene group or an arylene group; and p and q are independently integers of 0 or 1; and a step of processing said imagewise exposed photographic material with a color developing solution which contains a sulfite ion in a quantity of $2\times10^{-4}$ to $1\times10^{-2}$ mole/liter and is substantially free of bromide ion.

2. The method of claim 1, wherein said dye-forming coupler is selected from the group consisting of an acylacetonanilide-type yellow dye-forming coupler, a 5-pyrazolone-type magenta dye-forming coupler, a pyrazoloazole-type magenta dye-forming coupler, a phenole-type cyan dye-forming coupler and a naphthole type cyan dye-forming coupler.

3. The method of claim 1, wherein said dye-forming coupler is a magenta dye-forming coupler represented by general formula [aI];

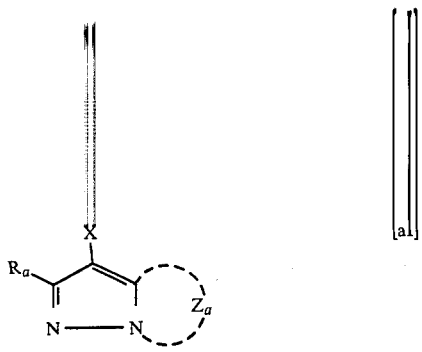

wherein Za is a group of non-metallic atoms necessary to complete a nitrogen-containing heterocyclic ring which may have a substituent, Ra is hydrogen atom or an organic substituent and X is an atom or a group which is capable of being split off upon coupling reaction with an oxidation product of a color developing agent.

4. The method of claim 1, wherein said dye-forming coupler is a cyan dye-forming coupler represented by general formula [E];

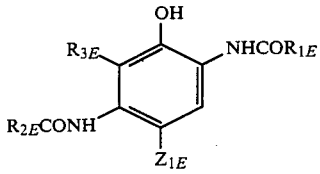

[E]

wherein $R_{1E}$ is selected from the group consisting of an aryl group, a cycloalkyl group and a heterocyclic group, $R_{2E}$ is selected from the group consisting of an alky group and a phenyl group, $R_{3E}$ is selected from the group consisting of a hydrogen atom, a halogen atom, an alkyl group, and an alkoxy group, and $Z_{1E}$ is a hydrogen atom or a group which is capable of being split off upon coupling reaction with an oxidation product of a color developing agent.

5. The method of claim 1, wherein said 5- or 6-membered heterocyclic ring of said 5- or 6-membered ring fused with a benzene ring is one selected from the group consisting of an imidazole ring, a tetrazole ring, a thiazole ring an oxazole ring, a selenezole ring, a benzimidazole ring, a naphthoimidazole ring, a benzothiazole ring, a naphthothiazole ring, a benzoselenazole ring, a naphthoselenazole ring, a benzoxazole ring, a pyridine and a pyrimidine.

6. The method of claim 1, wherein said compound represented by general formula [S] is one represented by general formula [SA];

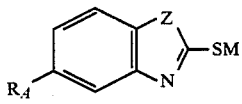

[SA]

wherein $R_A$ is selected from the group consisting of a hydrogen atom, an alkyl group, an alkoxy group, an aryl group, a halogen atom, a carboxylic group or a salt thereof a sulfo group or a salt thereof and Z is a group selected from —NH—, —O— and —S—, and M is a hydrogen atom, an alkali metal or an ammonium group.

7. The method of claim 1 wherein said silver halide grains contains a gold compound.

8. The method of claim 7, wherein said gold compound is selected from the group consisting of auric chloride, potassium chloroaurate, auric trichloride, potassium auric thiocyanate, tetracyanoauric azide, ammonium aurothiocyanate, pyridyltrichlorogold, gold sulfide, and gold selenide.

9. A method of forming a dye image comprising a step of imagewise exposing a light-sensitive silver halide photographic material which comprises a support and, provided thereon, at least one silver halide emulsion layer, said silver halide emulsion layer containing silver halide grains containing 90 mole % or more of silver chloride, a dye-forming coupler represented by general formula [aI];

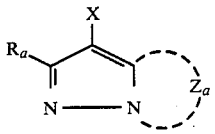

[aI]

wherein

Za is a group of non-metalic atoms necessary to complete a nitrogen-containing heterocyclic ring which may have a substituent, Ra is hydrogen atom or an organic substituent and X is an atom or a group which is capable of being split off upon coupling reaction with an oxidation product of a color developing agent; and a compound represented by general formula [S];

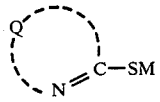

[S]

wherein

Q is a group of atoms necessary to complete a 5- or 6-membered heterocyclic ring or a 5- or 6-membered ring fused with a benzene ring and M is a hydrogen atom, an alkali metal or an ammonium group;

and a step of processing said imagewise exposed photographic material with a color developing solution which contains a sulfite ion in a quantity of $2\times10^{-4}$ to $1\times10^{-2}$ mole/liter and is substantially free of bromide ion.

10. A method of forming a dye image comprising a step of imagewise exposing a light-sensitive silver halide photographic material which comprises a support and, provided thereon, at least one silver halide emulsion layer, said silver halide emulsion layer containing silver halide grains containing 90 mole % or more of silver chloride, a cyan dye-forming coupler represented by general formula [E];

[E]

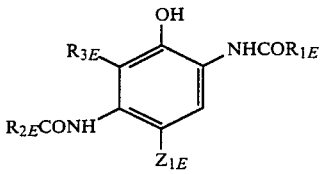

wherein $R_{1E}$ is selected from the group consisting of an aryl group, a cycloalkyl group and a heterocyclic group, $R_{2E}$ is selected from the group consisting of an alkyl group and a phenyl group, $R_{3E}$ is selected from the group consisting of a hydrogen atom, a halogen atom, an alkyl group, and an alkoxy group, and $Z_{1E}$ is a hydrogen atom or a group which is capable of being split off upon coupling reaction with an oxidation product of a color developing agent;

and a compound represented by general formula [S];

[S]

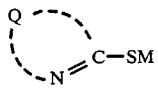

wherein

Q is a group of atoms necessary to complete a 5- or 6-membered heterocyclic ring or a 5- or 6-membered ring fused with a benzene ring and M is a hydrogen atom, an alkali metal or an ammonium group;

and a step of processing said imagewise exposed photographic material with a color developing solution which contains a sulfite ion in a quantity of $2\times10^{-4}$ to $1\times10^{-2}$ mole/liter and is substantially free of bromide ion.

11. A method of forming dye image comprising a step of imagewise exposing a light-sensitive silver halide photographic material which comprises a support and, provided thereon, at least one silver halide emulsion layer, said silver halide emulsion layer containing silver halide grains containing 90 mole % or more of silver chloride, a dye-forming coupler and a compound represented by general formula [SA];

[SA]

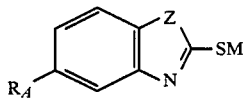

wherein $R_A$ is selected from the group consisting of a hydrogen atom, an alkyl group, an alkoxy group, an aryl group, a halogen atom, a carboxylic group or a salt thereof a sulfo group or a salt thereof and Z is a group selected from —NH—, —O— and —S—, and M is a hydrogen atom, an alkali metal or an ammonium group;

and a step of processing said imagewise exposed photographic material with a color developing solution which contains a sulfite ion in a quantity of $2\times10^{-4}$ to $1\times10^{-2}$ mole/liter and is substantially free of bromide ion.

* * * * *